US006134853A

United States Patent [19]

Haener

[11] Patent Number: 6,134,853

[45] **Date of Patent: *Oct. 24, 2000**

[54] INTERLOCKING INSULATED BUILDING BLOCK SYSTEM

[76] Inventor: Juan Haener, 8215 Harton Pl., San Diego, Calif. 92123

[ * ] Notice: This patent is subject to a terminal disclaimer.

[21] Appl. No.: 09/169,429

[22] Filed: Oct. 9, 1998

Related U.S. Application Data

[63] Continuation-in-part of application No. 08/805,361, Feb. 24, 1997, Pat. No. 5,822,939.

[51] Int. Cl.[7] ..... E04B 1/74

[52] U.S. Cl. ..... 52/405.2; 52/286; 52/309.9; 52/592.6; 52/606; 52/719; 52/745.1

[58] Field of Search ..... 52/100, 284, 286, 52/309.9, 404.1, 404.4, 405.1, 405.2, 405.3, 589.1, 592.6, 604, 606, 712, 719, 742.14, 745.1, 747.12

[56] References Cited

U.S. PATENT DOCUMENTS

| | | | |
|---|---|---|---|
| 1,149,648 | 8/1915 | Henderson | 52/719 |
| 1,343,926 | 6/1920 | Madsen | 52/712 X |
| 3,728,836 | 4/1973 | Gates | 52/712 X |
| 3,888,060 | 6/1975 | Haener | 52/284 |
| 4,148,166 | 4/1979 | Toone | 52/604 X |
| 4,640,071 | 2/1987 | Haener | 52/286 |
| 4,936,062 | 6/1990 | Golston et al. | 52/712 X |
| 5,379,565 | 1/1995 | Vienne | 52/606 |
| 5,575,128 | 11/1996 | Haener | 52/604 X |
| 5,711,129 | 1/1998 | Woolford | 52/592.6 X |
| 5,822,939 | 10/1998 | Haener | 52/606 X |

*Primary Examiner*—Carl D. Friedman
*Assistant Examiner*—Kevin D. Wilkens
*Attorney, Agent, or Firm*—Frank D. Gilliam

[57] ABSTRACT

An insulated building block system for use in building walls and other structures. Each full block has sidewalls and endwalls with a generally open interior and flat upper and lower surfaces. Two vertical ridges are provided along the interior of one sidewall, with a protrusion extending above the upper surface. The ridges are located such that an upper block arranged in staggered relationship to a block in a lower course will interlock with the lower block. Recesses are provided in the interior endwall surfaces to retain a thermal insulation panel against the interior sidewall surface opposite the ridges. Half blocks are also provided to fill spaces in wall end surfaces between staggered full blocks. The half blocks have open interiors for placement of insulation panels and include ridges for interlocking with protrusions on adjacent full blocks. First rebar ends extending up through lower courses filled with cement grout may be fastened to second rebar extending down through upper courses and aligned with the first rebar by ways of a loop of material secured to the second rebar. The second rebar end with the loop is inserted through an opening in the upper courses until the loop surrounds the extended end of the first rebar, then the second rebar is rotated to wind the loop material around the second rebar, bringing the ends of the first and second rebar together.

15 Claims, 6 Drawing Sheets

INTERLOCKING INSULATED BUILDING BLOCK SYSTEM

CROSS-REFERENCE TO RELATED APPLICATION

This application is a continuation-in-part of copending U.S. patent application Ser. No. 08/805,361, filed Feb. 24, 1997 and now U.S. Pat. No. 5,822,939.

FIELD OF THE INVENTION

This invention relates in general to blocks for use in construction of walls, buildings and the like and, more specifically, to an interlocking building block system that may include thermal insulation material.

BACKGROUND OF THE INVENTION

Conventional concrete block construction uses rectangular blocks, generally having one or more cavities through the blocks from top to bottom. A layer of mortar is thrilled onto a foundation and a course of closely spaced blocks are laid on the layer, with additional mortar applied between the contiguous block ends. Another layer of mortar is applied to the top of the first course and additional courses are similarly laid, generally staggering the block ends from course to course. Great care and skill is required to achieve level courses and a truly vertical wall. Because of the time and skill required for such construction, costs are high. These blocks have vertically aligned cavities that can be filled with rebar and concrete to reinforce the wall.

Various types of mortarless interlocking blocks have been devised in the past to facilitate the construction of block walls and other structures. Most such blocks have been very expensive to produce since the interlocking portions, usually grooves or protrusions, are normally cut into the blocks after they have been formed by molding. Further, it is difficult to maintain the required tight tolerances required for accurate construction of large walls or other structures through the molding and cutting steps. The prior blocks often required additional finishing or grinding steps to meet the require tolerances.

Excellent interlocking mortarless building blocks overcoming many of these deficiencies are describe in U.S. Pat. Nos. 3,888,060, and 4,640,071, both granted to the inventor of the present invention. Those blocks have been used successfully for many years. These blocks are assembled in courses, with the block joints staggered and continuous vertical open cells into which reinforcing bars ("rebar") and concrete grout can be inserted. While highly effective, these blocks require that rebar be inserted in lower courses, with blocks in later courses lifted over the ends of the rebar as the structure advances and wet concrete is periodically poured into the cells containing the rebar. Thus installing blocks over rebar can be a significant problem with tall structures.

Also, three or more different block configurations may be required for many structures, such as walls, buildings with openings and floor panels connected to the block wall. Additional block configurations require the manufacture of additional expensive molds and increased cost and time in changing molds in a block making machine and maintaining and inventory of the different block configurations.

Many of building walls made from these blocks have excessive thermal conductivity across the wall, which is a particular problem in cold climates where the interior is heated or in hot climates where the interior is cooled. Heat transmission across such a wall varies between areas where the blocks have large open internal cavities and areas where the cavities are filled with concrete and rebar reinforcements. In addition to the undesirable loss of interior heating or cooling through the wall, with heated buildings, cold spots may form on the interior of the wall that condense water from the inside atmosphere and run down the wall.

Attempts have been made to fill the block cavities with loose fiberglass insulation, loose foam particles, foamed in place materials, etc. Loose insulation tends to settle and provide very uneven insulation with resulting cold spots. The insulation cannot be placed in block cavities that are to be filled with concrete and rebar reinforcements, again resulting in thermal gradients along the wall, with widely varying interior wall temperatures at insulated and uninsulated areas.

Therefore, there is a continuing need for improvements in these successful block systems to permit lower cost block manufacture and lower cost, more rapid structure assembly from the blocks, the ability to provide thermal insulation in all blocks while still permitting the introduction of reinforcing concrete and rebar into all or some of the blocks and to place such reinforcement with insulation already in place.

SUMMARY OF THE INVENTION

The above noted problems are overcome, and advantages achieved, by a block system which includes two basic block configurations including a first, full, block, typically having a length at least twice the block width, and a second, half, block, typically no more than half the length of the long block, for filling in at wall ends and openings. Only two different blocks are require, the full length block and the half block.

Each block includes an interior cavity extending the full block length between endwalls, with means along the endwalls for supporting and holding in place thermal insulation panels which may be made from any suitable insulating material, preferably a closed cell plastic foam.

Each of said first, long, blocks has a pair of spaced, upright sidewalls each having flat top and bottom surfaces and generally parallel outermost side surfaces. The block face surfaces may have various decorative designs, as desired. Block end interlock means, typically cooperating vertically oriented tongue-and-groove arrangements, are provided at the ends of the sidewalls. Endwalls close the ends of the block between the sidewalls.

Two inwardly extending vertical ridges are provided along one sidewall which extend slightly above the block upper surface, forming protrusions that interlock with a vertical recess along the lower ends of the ridges on the block laid in the next above course. A side portion of the vertical ridge forms the edge of the interlocking recess.

It has been found that if the interlocking upper protrusion on a ridge extends to a level coplanar with the upper block surface, and is squared off, during molding of the block it is highly likely that the interlock protrusion will not entirely fill with concrete. This will result in a weak link between blocks, and misalignment between the blocks, in succeeding courses. In order to overcome this problem, while retaining sufficient support for the protrusion and sufficient width to the side ridge extension to maintain the interlocking recess, configuring the upper end of the side extension where it meeds the protrusion at an angle to the plane of the block upper surface of from about 45 to 55 degrees is critical.

Half blocks are provided for filling the ends of walls between staggered full block courses. The half blocks are dimensioned the same as the full blocks, but are half the length of the full blocks and have a generally U-shaped plan, with a pair of spaced parallel sidewalls connected by an endwall at one end. The half block further includes tapered ridges running vertically along the inside surfaces of the sidewalls, arranged to interlock with an upwardly extending ridge protrusion on the next full block below the half block. Insulation may be placed along the sidewalls and endwall of the half block.

With this system, it is not necessary that rebar having a length equal to the full wall height be installed when construction of the wall is begun. With full height rebar, each block would have to be lifted over the full rebar height during installation.

A shorter first rebar is installed after the wall has reached a selected height. The first rebar extends s predetermined distance above the partially built wall. The openings containing each first rebar are filled with concrete grout. A second length of rebar is secured to the extending end of the original rebar with wire or strapping. Wire or strip material is fastened around the extending end of a second rebar in a manner leaving a loop in a horizontal plane adjacent to the lower second rebar end. Layup of additional block courses continues. When a predetermined height is reached, a second rebar having a loop extending generally perpendicular to the rebar length is inserted down through the added block courses until the loop surrounds the extended end of the first rebar. The second rebar can be rotated about its length to wind the wire forming the loop about the second rebar and bring the rebar ends close together. The cavity around the second rebar is then filled with concrete grout. This sequence can continue until the wall reaches the final height.

The blocks of this invention, when insulation is installed, take advantage of the differences in thermal conductivity of the insulating material and the concrete. Typically, the thermal conductivity of concrete is about 54 times higher than that of conventional foam insulation material, concrete typically having a thermal conductivity of about 12 Btu-in/hr-ft$^2$ ° F., while insulation typically has a thermal conductivity of about 0.22 Btu-in/hr-ft$^2$ ° F. The thermal bridge through the abutting block ends beyond the insulation material is narrow. With the insulation along the outer face of the block, the heat exchange takes place in that vicinity. As the heat travels over the thermal bridge into the concrete it distributes in all directions so that no narrow hot or cold spots will form. The temperature of the block surface along the inside surface of the wall will be substantially uniform and constant.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
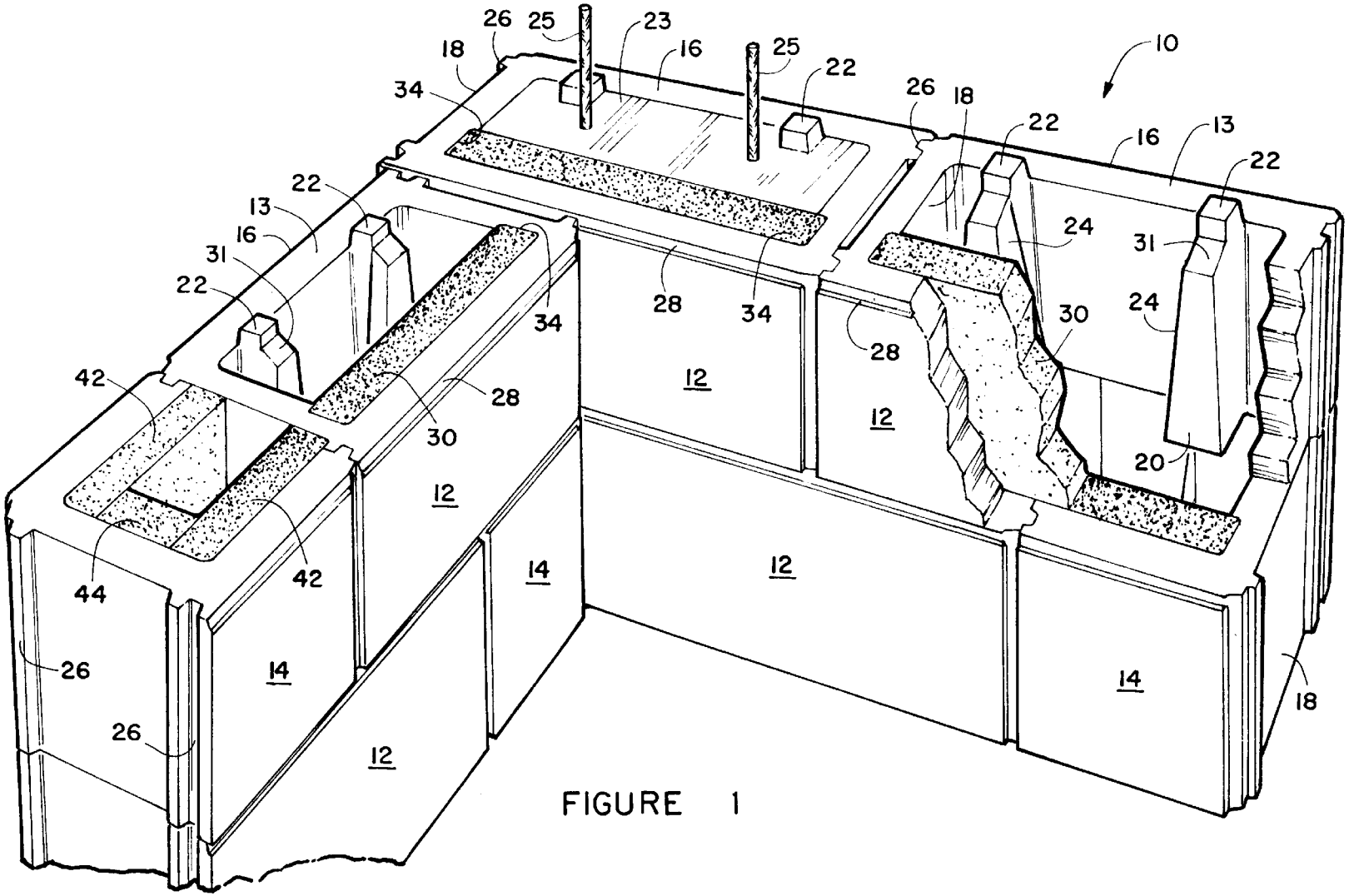
FIG. 1 is a perspective view of a wall built using the block system of this invention.

Referring to FIG. 1, there is seen a wall 10 primarily laid up in a staggered array from a plurality of full blocks 12. Each full block has a width equal to one-half its length. At the ends of a wall, every other course will have an opening equal to half a block 12. Half blocks 14 are provided to fill these spaces. Similar spaces will occur at the vertical edges of doors, windows and the like.

Figures 2, 3, 4:
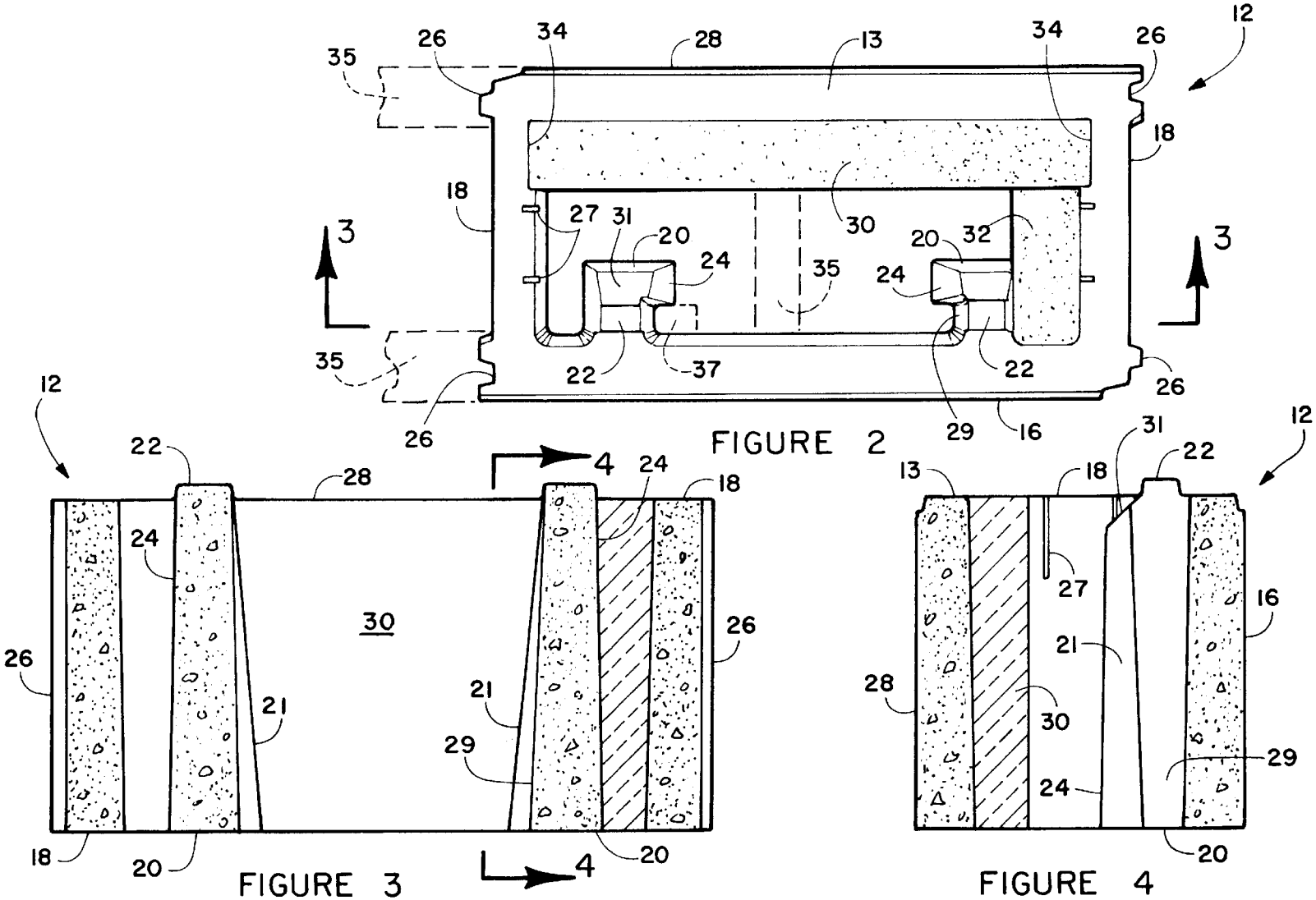
FIG. 2 is a plan view of a full block.
FIG. 3 is a section view taken on line 3—3 in FIG. 2.
FIG. 4 is a section view taken on line 4—4 in FIG. 3.

As best seen in FIG. 2, the full blocks 12 having an upper surface 13 formed by the upper edges of two sidewalls 16 and 28 joined with two endwalls 18. The bottom surface of each block is substantially flat. Each of the nominally vertical interior surfaces within block 10 (e.g., the inner surfaces of the end walls 18, sidewalls 16 and 28, ridges 20, etc.) tapers very slightly towards the inner block volume to provide relief for mold removal. This conventional slight taper is somewhat exaggerated in the drawings for clarity.

Figure 10:
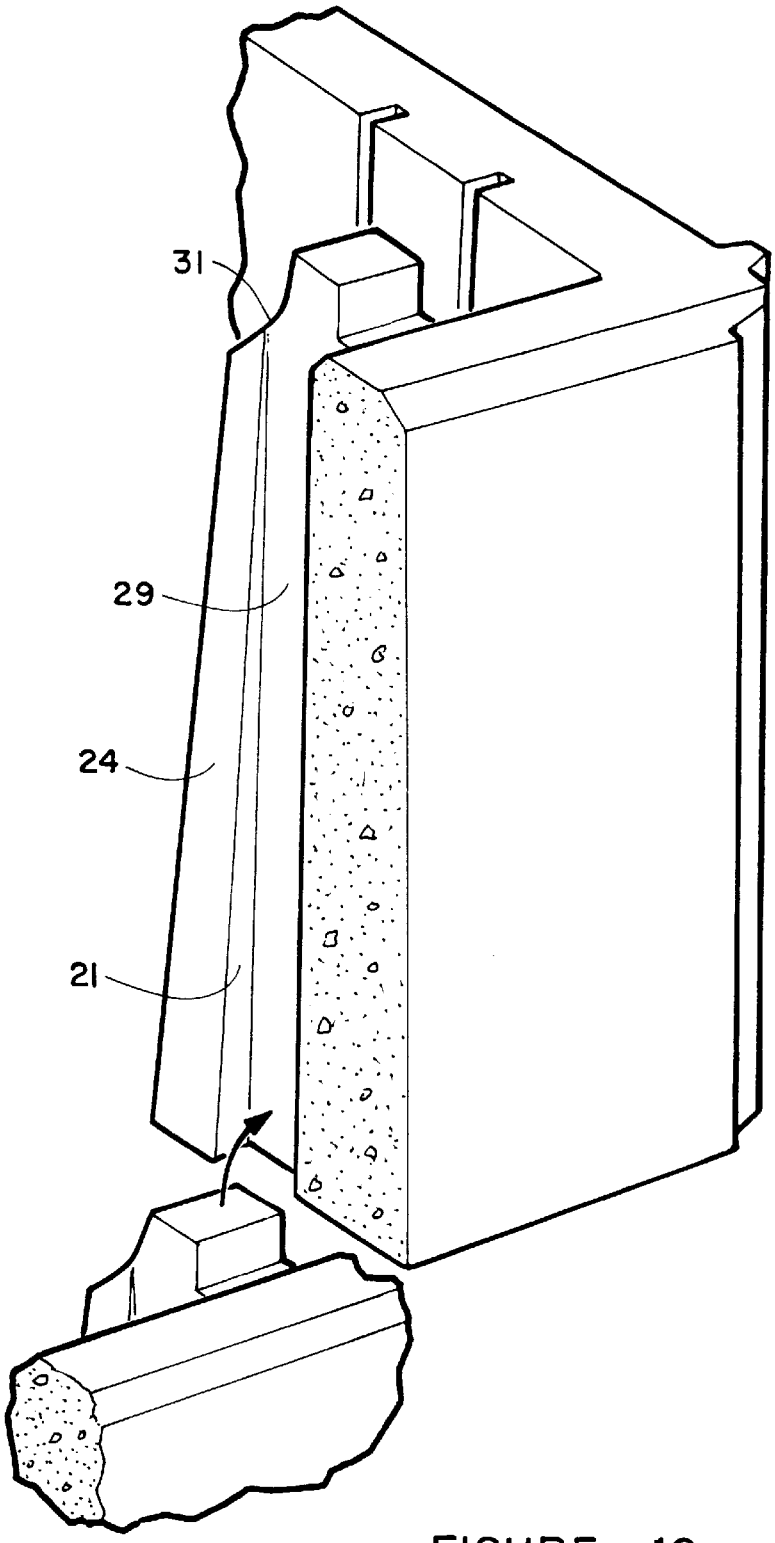
FIG. 10 is a schematic perspective view showing the interlocking of blocks in succeeding courses.

Each full block 12 has a pair of inwardly extending vertical ridges 20 on the inside of a first sidewall 16. Each ridge 20 has a distal protrusion 22 extending above the otherwise flat upper surface 13 of each full block 12. The distal protrusion 22 is offset very slightly toward the interior of block 10 to accommodate sidewall taper, as best seen in FIGS. 2, 4 and 10. Ridges 20 are located so that a protrusion 22 of a lower block 35 (as shown in broken lines in FIG. 2 and schematically illustrated in FIG. 10) will engage the proximal end of a ridge 20 as seen in FIG. 2 when the lower block extends half way along the upper block. Protrusion 22 is locked in place between the inner sidewall surface, a side 21 of a ridge 20 and a tapered extension 24 along each ridge 20 forming a generally vertical recess 29 along ridge 20. In order to provide a recess 29 having the desired strength, the width of ridge 22 (in a direction perpendicular to sidewall 16) is preferably approximately twice the width of protrusion 22 in the same direction. Because to the mold release taper, the width of ridge 22 is optimally from about 1.8 to 2.2 times the width of protrusion 22.

It has been found that if the upper end portion extends to a level coplanar with upper surface 13 of block 10, and is squared off, during molding of block 10 it is highly likely that protrusion 22 will not entirely fill with concrete. This will result in a weak link between blocks, and misalignment between the blocks, in succeeding courses. In order to overcome this problem, while retaining sufficient support for protrusion 22 and sufficient width to extension 24 to maintain recess 29, configuring the upper end of extension 24 at an angle to the plane of upper surface 13 of from about 45 to 55 degrees is critical.

In order to prevent undesirable stress risers, edges of protrusion 22 and the transition between protrusion 22 and sloping upper portion 31 may beneficially be slightly radiused.

Since most of the block interior is open, cement grout 23 and rebar 25 can be easily be placed vertically through vertically aligned openings through blocks making up wall 10. As seen in FIG. 1, the entire interior of uppermost block 12 is filled with grout 23. The next lower blocks have endwalls meeting below the center of the upper block, with two spaced cavities that will fill with grout. The rebar 25 will extend through these cavities, together with the grout 23 poured in from above.

Preferably, each block 12 includes tongue-and-groove interlocking means 26 at each to further hold blocks along a course in the proper position. Grooves 27 (FIGS. 2 and 3) may be provided in the upper inner edge of each endwall 18 so that a portion of the upper edge may be easily broke away to allow rebar to extend along the length of the course.

Each sidewall 18 has a vertical groove 34, continuous with second sidewall 28, to receive an end of an insulation panel 30 which is sized to cover the inner surface of sidewall 28. Where a particular full block has an end exposed at an end of a wall a small insulation panel 32 can be inserted along the exposed endwall 18, as seen in FIG. 2.

Figure 5:
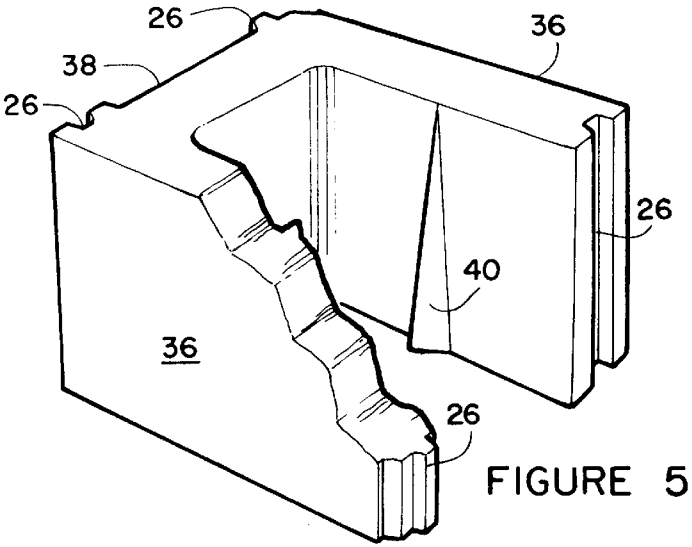
FIG. 5 is a perspective view of a half block.
Figure 6:
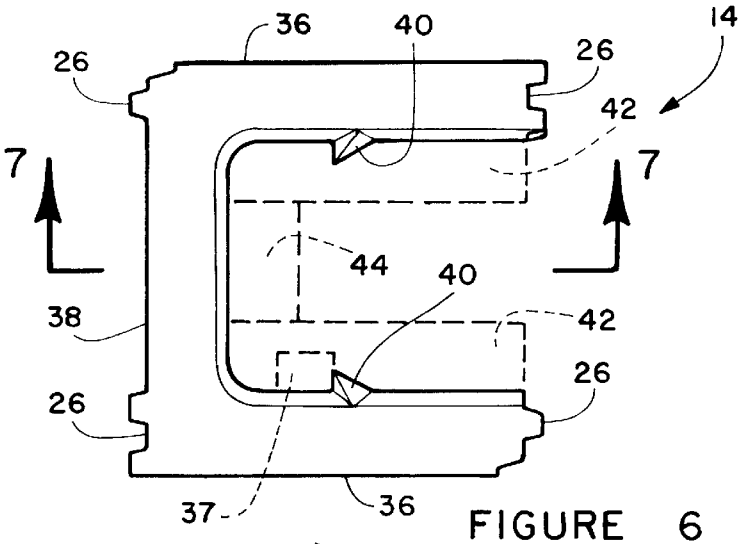
FIG. 6 is a plan view of a half bock.
Figure 7:
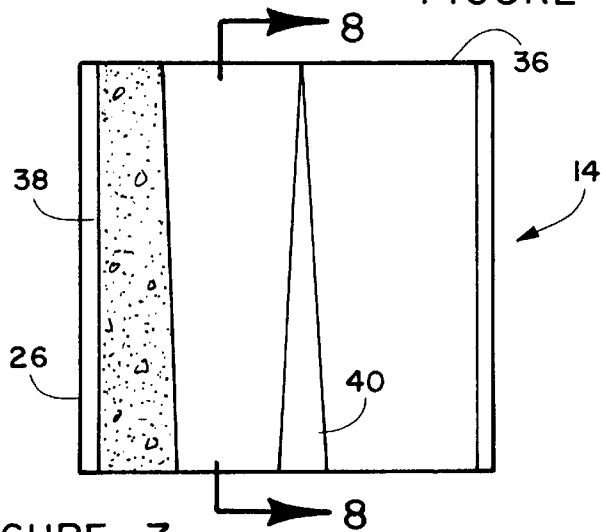
FIG. 7 is a section view taken on line 7—7 in FIG. 6.
Figure 8:
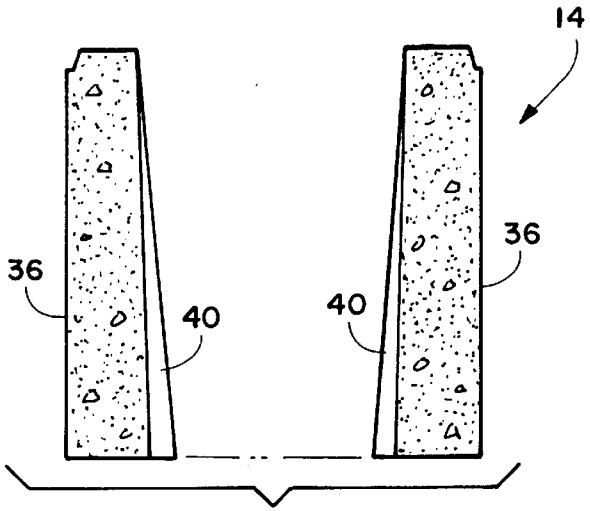
FIG. 8 is a section view taken on line 8—8 in FIG. 7.

A half block 14 as seen in FIGS. 5–7 is provided to fill in along wall ends, as mentioned above. Half block 14 has two parallel sidewalls 36 connected by an endwall. The half block sidewalls 36 have the same general configuration as full block sidewalls 16, except that they have half the length. A vertical tapered ridge 40 is provided along the inner surface of each sidewall 16, located to interlock with a protrusion 22 from a full block 12 immediately below a half block 14. A tapered ridge 40 is provided on each sidewall 36, so that the half block can be used at either a left or a right wall end.

A half block side insulation material 42 may be positioned along the interior of each sidewall 36, and a small panel 44 may be fitted between panels 42 across the interior of endwall 38 between panels 42. If desired, recesses may be provided in the inside edges of endwall 38, similar to recesses 34 shown in FIG. 2, and recesses could be provide in side insulation material 42 to receive ends of small insulation material sheets 44. The insulation material 42 can be molded to accommodate ridges 40 and protrusion 22 on the next lower block, which extend into volumes occupied by the insulation, or soft foam or fibrous insulation may be used that will simply compress when pressed into place over ridges and protrusions.

Figure 9:
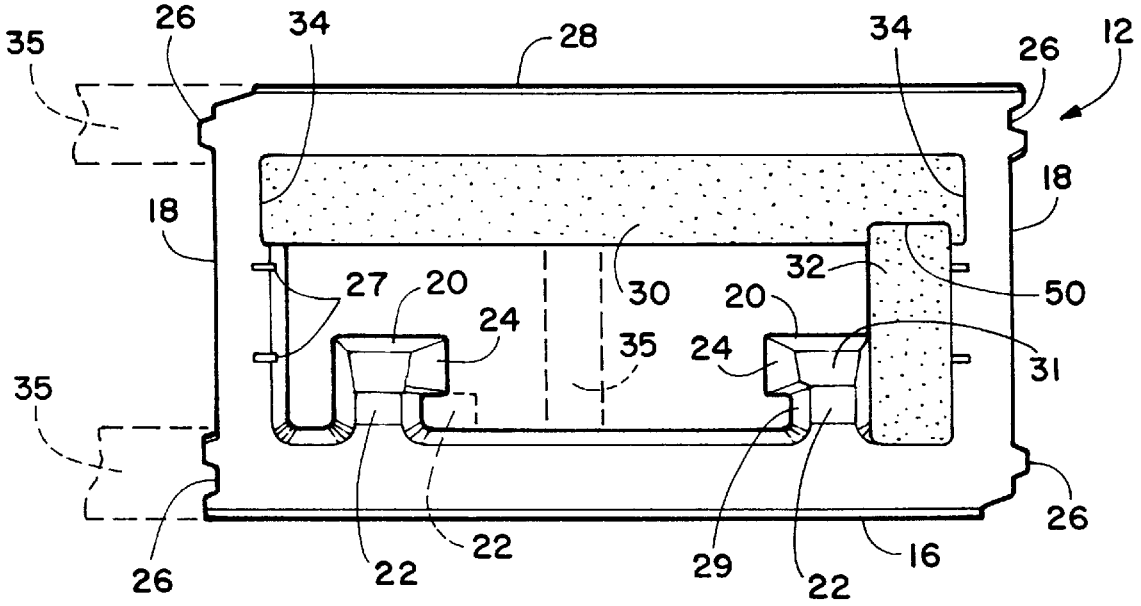
FIG. 9 is a plan view of an alternate embodiment having means for securing end insulation panels to side insulation panels.

FIG. 9 shows an alternate embodiment of the arrangement for securing end insulation panels 32 in place along the interior surface of endwall 18. A recess or groove 50 may be provided in insulation panel 30 into which an end of small end insulation panel 32 can be received. All other components shown are the same as shown in FIG. 2.

As each course is laid up, the various insulation panels are inserted before the next course is laid. If desired, the panels could be further adhesively bonded in place at the block manufacturing facility and shipped to the construction site. Once the wall is constructed to a suitable level, grout and rebar may be used to fill the vertical channel provided by the aligned openings in the blocks. Since the interior of the blocks are free of any structure, filling is easy and complete filling is assured. The final wall is sturdy and thermally insulated.

Figure 11:
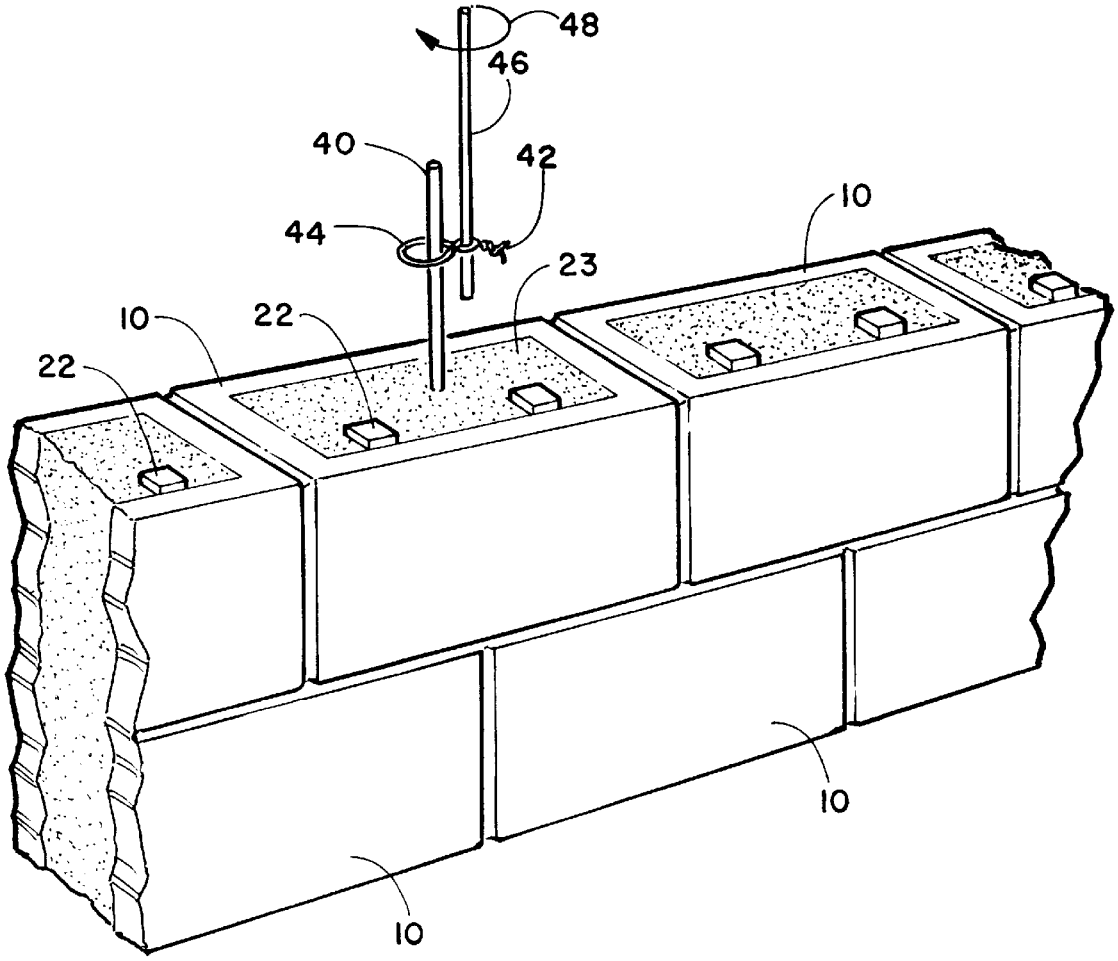
FIG. 11 is a schematic perspective view showing the installation of an upper rebar during wall construction.

In order to eliminate any need to lift blocks over rebar extending the entire completed height of a wall, shorter lengths of rebar may be incrementally secured together during wall construction. As seen in FIG. 11, a first rebar 40 of predetermined length is secured in the first courses of blocks 10 through each of several vertically aligned block openings. The blocks are easily lifted over the relatively short first rebar 40. When the block lay up approaches the top ends of first rebar 40, the openings around each rebar are filled with concrete grout 23. Construction is continued for an additional number of block courses.

A flexible material 42 that is shape retaining, such as iron wire, thin metal straps, etc. is twisted very tightly around an end of a second length of rebar 46 to secure the material 42 to rebar 46 while forming a loop 44 in a plane perpendicular to the rebar. The loop can be nearly as large as the aligned, essentially half block wide, opening through the additional block courses.

Rebar 46 is extended down through the additional courses until loop 44 is positioned around upwardly extending rebar 40. Then rebar 46 is manually rotated about its length as indicated by arrow 48, causing the soft wire of loop 44 to wrap around rebar 46, gradually bringing the lower end of rebar 46 into snug engagement with the upper end of rebar 40, substantially at the center of the cavity.

The vertically aligned cavities can then be filled with concrete grout 23, with the upper end of second rebar 46 extending above the upper surface if further courses are to be laid.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. An interlocking block system for use in a wall construction utilizing a plurality of blocks, at least some of which blocks which comprise:

pair of generally rectangular spaced parallel first and second sidewalls having substantially flat upper and lower surfaces and end edges generally perpendicular to said upper and lower surfaces and each having an internal and an external surface;

a pair of generally rectangular spaced, parallel endwalls, each transverse to said sidewalls, joined to said sidewalls and each having an internal and an external surface;

two spaced inwardly extending ridges along said first sidewall each lying generally parallel to said end edges;

said ridges including ridge protrusions extending beyond said first sidewall upper surface;

each ridge having a recess extending substantially parallel to said first sidewall internal surface;

each said recess bounded by said sidewall internal surface and an extension of said ridge running generally parallel to said sidewall internal surface between said sidewall upper and lower surfaces;

each said extension having an end surface adjacent to said ridge protrusion;

each extension end surface extending approximately from an intersection between said protrusion and said extension end surface toward said sidewall lower surface at an angle to said sidewall upper surface of from about 45 to 55 degrees; and said ridge protrusions located so that when one of said blocks is placed over a second said block with said first sidewalls substantially coplanar and an endwall of the upper block substantially at the center of said lower block, a ridge protrusion on said lower block will interlock in said recess of said upper block.

2. The block system according to claim 1 wherein at least some blocks have an interior space between said sidewalls and between said endwalls which is substantially open and unobstructed.

3. The block system according to claim 1 further including at least one groove in each endwall interior surface extending partially through said endwall.

4. The block system according to claim 1 further including block to block interlock means at each block end.

5. The block system according to claim 1, further including:

an endwall groove in each endwall internal surface, contiguous with said second sidewall, for receiving an edge of a sidewall insulation panel; and a panel of thermal sidewall insulation material fitted into said endwall grooves contiguous with said second sidewall.

6. The block system according to claim 5 wherein said sidewall insulation panel is formed from closed cell foam material.

7. The block system according to claim 5, further including a groove in said sidewall insulation panel for receiving a corresponding projection on an end of an endwall insulation panel for positioning said endwall insulation panel along an endwall interior surface.

8. An interlocking block system for use in a wall construction utilizing a plurality of blocks, at least some of which blocks which comprise:

pair of generally rectangular spaced parallel first and second sidewalls having substantially flat upper and lower surfaces and end edges generally perpendicular to said upper and lower surfaces and each having an internal and an external surface;

a pair of generally rectangular spaced, parallel endwalls, each transverse to said sidewalls, joined to said sidewalls and each having an internal and an external surface;

two spaced inwardly extending ridges along said first sidewall each lying generally parallel to said end edges;

said ridges including ridge protrusions extending beyond said first sidewall upper surface;

each ridge having a recess extending substantially parallel to said first sidewall internal surface;

each said recess bounded by said sidewall internal surface and an extension of said ridge running generally parallel to said sidewall internal surface between said sidewall upper and lower surfaces;

each said extension having an end surface adjacent to said ridge protrusion;

each extension end surface extending approximately from an intersection between said protrusion and said extension end surface toward said sidewall lower surface at an angle to said sidewall upper surface of from about 45 to 55 degrees, said ridge protrusions located so that when one of said blocks is placed over a second said block with said first sidewalls substantially coplanar and an endwall of the upper block substantially at the center of said lower block, a ridge protrusion on said lower block will interlock in said recess of said upper block; and an endwall groove in each endwall internal surface, contiguous with said second sidewall, for receiving an edge of a sidewall insulation panel.

9. The block system according to claim 8 wherein at least some blocks have an interior space between said sidewalls and between said endwalls which is substantially open and unobstructed.

10. The block system according to claim 8 further including at least one groove in each endwall interior surface extending partially through said endwall.

11. The block system according to claim 8 further including block to block interlock means at each block end.

12. The block system according to claim 8 further including a panel of closed cell foam thermal sidewall insulation material fitted into said endwall grooves contiguous with said second sidewall.

13. The block system according to claim 12, further including a groove in said sidewall insulation panel for receiving a corresponding projection on an end of an endwall insulation panel for positioning said endwall insulation panel along an endwall interior surface.

14. A method of assembling a wall from blocks having a length greater than height and having at least one interior opening parallel to said height, which comprises the steps of:

laying up a plurality of said blocks in courses to a first predetermined height with said blocks arranged so that said openings at least partially align from course to course;

installing at least one first rebar of predetermined length into an aligned opening though said courses so that said first rebar extends a predetermined distance above an uppermost course surface;

filling said aligned opening with concrete grout;

securing a loop of shape retaining, easily deformable material adjacent to a first end of a second rebar with said loop lying substantially perpendicular to said second rebar;

laying up additional courses of said blocks, said additional courses having an opening therethrough in alignment with said first rebar;

extending said first end of said second rebar into said opening in said additional courses until said loop surrounds said first rebar;

rotating said second rebar to wind said loop around said second rebar and bring said second rebar into parallel engagement with said first rebar; and filling said aligned openings around said second rebar with concrete grout.

15. The method according to claim 14, wherein said loop is formed from a soft metal wire and said wire is secured to said second rebar by twisting ends of said soft wire around said second rebar while forming said loop adjacent to said second rebar.

* * * * *